US005215432A

United States Patent [19]

Pickering et al.

[11] Patent Number: 5,215,432

[45] Date of Patent: Jun. 1, 1993

[54] STATOR VANE DAMPER

[75] Inventors: Raymond A. Pickering, Tequesta; William A. Thomson, Indiantown, both of Fla.

[73] Assignee: United Technologies Corporation, Hartford, Conn.

[21] Appl. No.: 728,508

[22] Filed: Jul. 11, 1991

[51] Int. Cl.[5] ..... F01D 5/10

[52] U.S. Cl. ..... 415/119; 415/191; 416/500

[58] Field of Search ..... 415/119, 191; 416/248, 416/500, 190, 193 A

[56] References Cited

U.S. PATENT DOCUMENTS

| | | | |
|---|---|---|---|
| 3,936,222 | 2/1976 | Asplund et al. | 416/193 A |
| 4,451,204 | 5/1984 | Pask | 416/248 |
| 4,470,757 | 9/1984 | Vollinger | 416/193 A |
| 4,516,910 | 5/1985 | Bouiller et al. | 416/193 A |
| 4,621,976 | 11/1986 | Marshall et al. | 415/191 |
| 4,721,434 | 1/1988 | Marshall et al. | 415/119 |

FOREIGN PATENT DOCUMENTS

| | | | |
|---|---|---|---|
| 1263677 | 5/1961 | France | 416/500 |
| 17306 | 1/1987 | Japan | 416/500 |

*Primary Examiner*—John T. Kwon
*Attorney, Agent, or Firm*—Edward L. Kochey, Jr.

[57] ABSTRACT

The vane platform 14 of each vane 12 has an inwardly extending foot 14. A resilient spring damper 24 extends from the base end 28 of the foot and is biased against the platform 14 at a remote contact location 32.

4 Claims, 2 Drawing Sheets

STATOR VANE DAMPER

The Government has rights in this invention pursuant to a contract awarded by the Department of the Air Force.

DESCRIPTION

Technical Field

The invention relates to gas turbine engines and in particular to frictional damping of stator vanes.

Background of the Invention

Axial flow gas turbine engines, comprising compressors and turbines, are constructed of alternate sets of rotors and stators of a quantity and specific design as needed to meet the flow and pressure requirements of the engine cycle. The stators are constructed of an annular array of identical vanes. These vanes are supported at one or both ends by circular rings.

These rings structurally support the vanes and also provide the flow path boundaries. The inner rings conventionally also support a seal structure to limit gas bypass or air recirculation.

Because of differential expansion between the outer and inner rings it is now common to segment the inner ring or to actually form it of individual separate components. It is therefore known to use vane platforms at the inner edge of the vanes. These platforms are loosely tied together with a seal carrier connected to a plurality of the vane platforms.

The turbulence of the air flow causes vibratory excitation of the vanes and therefore the vanes vibrate in different modes at one or more of the natural frequences. The vibration produces stress, leading to fatigue failure of the vanes.

While the seal support ring provides some damping against vibration it occasionally is not sufficient. Various frictional dampers have been introduced to further damp the vibration.

SUMMARY OF THE INVENTION

A plurality of circumferential stator vanes are secured at the outer end to an outer shroud. Each stator vane has a vane platform secured to the inner end. The blade platform has an inwardly extending foot which is rigidly connected to the vane platform and this foot has a base remote from the vane platform.

A resilient spring damper is rigidly secured to each foot in a manner where it extends axially from the foot at the base end. The resilient spring damper contacts the platform at a contact location remote from the foot.

With the spring damper extending from the base end of the foot, the motion of the damper is a function of the movement of the foot at this remote location. This is significantly greater than the motion of the foot adjacent to the platform and accordingly produces more movement of the spring damper than alternate construction.

The resilient spring in extending from the base end to the contact point is constructed so that it does not have excessive flexibility in the direction toward and away from the foot. Thus provides sufficient stiffness to achieve frictional movement rather than just deflection of the spring damper itself.

DESCRIPTION OF THE PREFERRED EMBODIMENT

Figure 1:
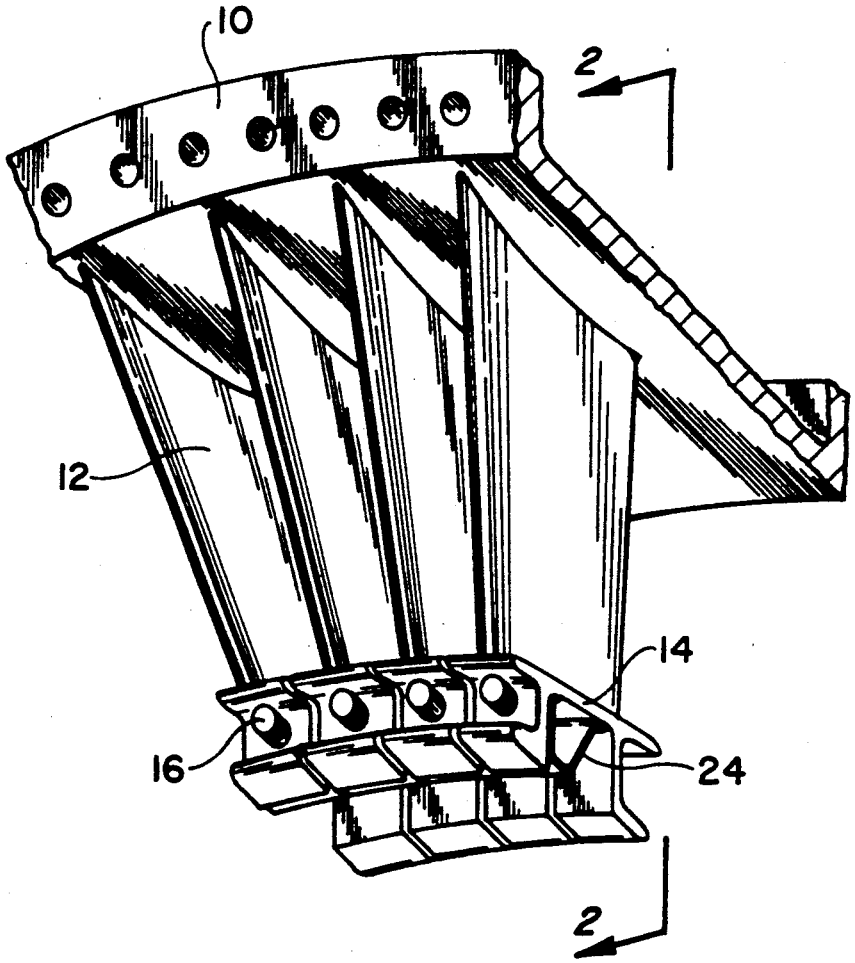
FIG. 1 is a isometric view of a plurality of vanes with the spring dampers installed.
Figure 2:
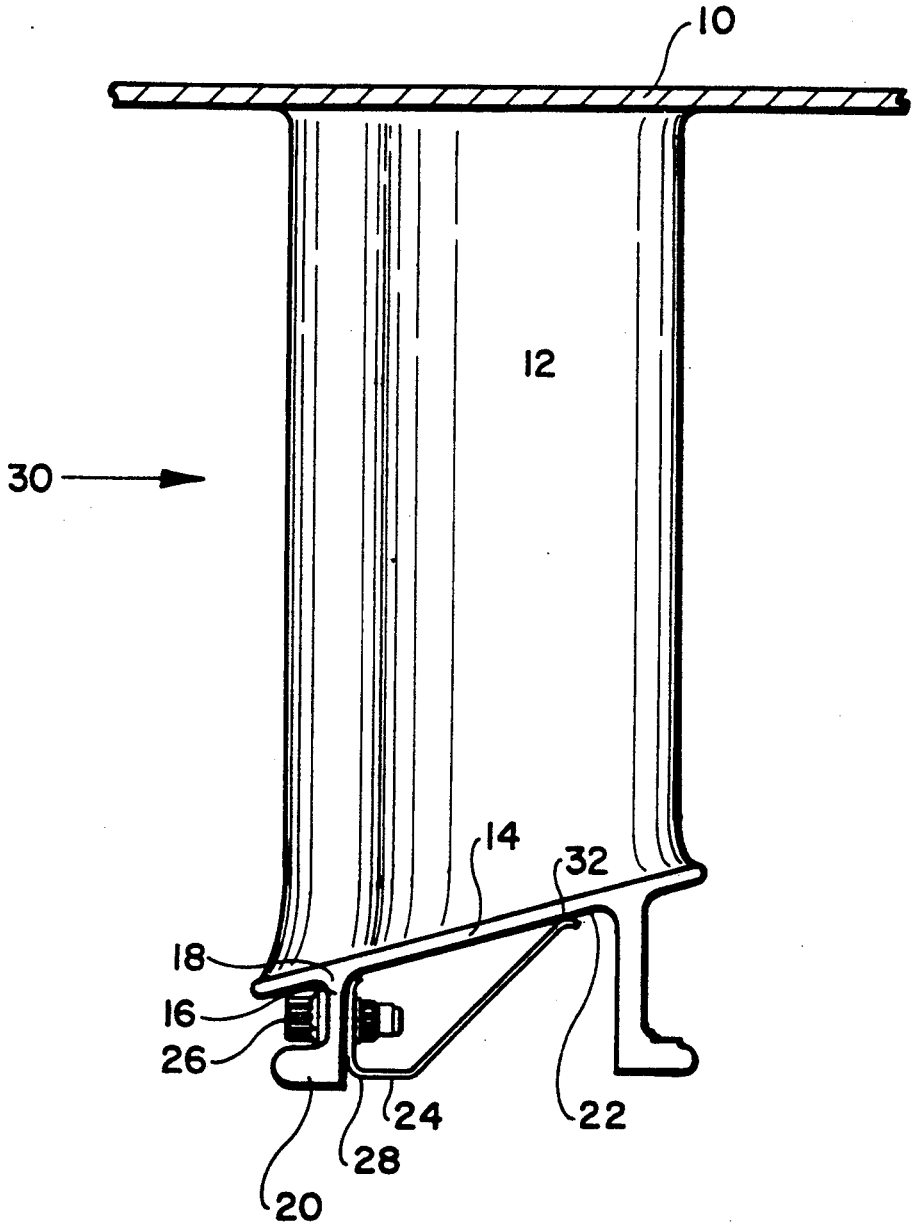
FIG. 2 is a side view of a vane and spring damper.

Continuous outer shroud 10 of a gas turbine engine carries a plurality of circumferentially arranged stator vanes 12. These vanes are secured at their outer end to the shroud. A plurality of vane platforms 14 are secured to the inner edge of the plurality of vanes.

Each vane platform has an inwardly extending foot 16 rigidly connected at point 18 to the vane platform 14 and preferably integral therewith. Each foot has a base end 20 remote from the platform.

As the vane 12 vibrates distortion occurs in the blade platform 14 and in the foot 16. The relative motion is greatest between a location 22 of the platform remote from the foot and the base end 20 of the foot.

Resilient spring damper 24 is rigidly secured to the foot by bolt 26. The spring damper extends from location 28 which is remote from the platform in a direction which is generally axial with the gas flow 30. It extends up to contact point 32 which is remote from the foot and the spring is designed to be resiliently biased against the platform 14 as bolt 26 is tightened.

The motion of the base 20 of foot 16 is transmitted through the spring damper 24 to the contact point 32. With this structure the maximum differential movement is achieved, and better damping results have been achieved than with other spring dampers which have been tried.

The spring damper requires some flexibility in the direction normal to the contact surface of platform 14 to maintain its contact during vibration and to maintain contact even after some wear occurs. On the other hand stiffness in a direction parallel to the platform 14 is desired to avoid flexing of the spring damper in this direction rather than frictional sliding. Accordingly, it is preferred that no portion of damper 14 between the base end 28 and the contact point 32 be at an angle of less than 30° with respect to the perpendicular to platform 14, thereby avoiding excess flexibility in direction parallel to the platform.

We claim:

1. A damped stator for a gas turbine engine having an axis comprising:

a continuous outer shroud;

a plurality of circumferentially arranged stator vanes secured at the outer end to said outer shroud;

a plurality of axially extending vane platforms secured to the inner end of said plurality of vanes;

an inwardly extending foot rigidly secured to each vane platform and having a base end remote from said platform;

a resilient spring damper rigidly secured to each foot and extending axially from said base end; and said resilient damper contacting and biased against said platform at a contact location remote from said foot.

2. A damped stator for a gas turbine engine as in claim 1, comprising also:

said resilient spring damper extending from said base end of said foot to said contact point with no portion of said spring damper between said foot and said contact point being less that 30° from the perpendicular to said platform.

3. A damped stator for a gas turbine engine as in claim 1:

each vane platform secured to only a single vane.

4. A damped stator for a gas turbine engine as in claim 2:

each vane platform secured to only a single vane.

* * * * *